US005315280A

United States Patent [19]

Stokes et al.

[11] Patent Number: 5,315,280

[45] Date of Patent: May 24, 1994

[54] BOBBIN FOR ELECTRICAL WINDINGS

[75] Inventors: Rembert R. Stokes, Inverness; Anand K. Upadhyay, Libertyville, both of Ill.

[73] Assignee: Motorola Lighting, Inc., Buffalo Grove, Ill.

[21] Appl. No.: 719,224

[22] Filed: Jun. 21, 1991

[51] Int. Cl.[5] ..... H01F 15/10

[52] U.S. Cl. ..... 336/192; 336/170; 336/196

[58] Field of Search ..... 336/170, 171, 180, 182, 336/186, 192, 195, 196, 199, 208, 213; 310/184, 192, 194; 29/605; 323/308

[56] References Cited

U.S. PATENT DOCUMENTS

| | | | |
|---|---|---|---|
| 3,652,968 | 3/1972 | Johnston et al. | 336/170 |
| 3,661,342 | 5/1972 | Sears | 242/118.41 |
| 4,473,811 | 9/1984 | Schauble | 336/171 |
| 4,549,130 | 10/1985 | Dobberstein | 336/308 |
| 4,857,878 | 8/1989 | Eng, Jr. et al. | 336/192 |
| 4,962,361 | 10/1990 | Ida | 336/90 |

*Primary Examiner*—Leo P. Picard
*Assistant Examiner*—Christopher Horgan
*Attorney, Agent, or Firm*—J. Ray Wood

[57] ABSTRACT

A transformer (202) has a bobbin (2) which has an inner portion (104) supporting an inner electrical winding (140) and having a magnetic core recess. The inner portion is located within an outer portion (4) supporting an outer electrical winding (40). The inner portion further has an end with a termination connected to the inner winding, an annular recess (126) in which the inner winding is situated, and a channel (132) communicating between the termination end of the inner portion and a remote end of the annular recess. The channel is positioned radially inwardly of the first annular recess and accommodates a portion of the inner winding. By providing the channel radially inwardly of the annular recess, winding wire can extend between the termination end of the inner portion and the remote end of the annular recess across the annular recess without significantly increasing the size of the inner portion and without increasing the gap between the inner and outer portions. This allows the size, weight and cost of a transformer built with the bobbin to be reduced, and improves the transformer's magnetic performance. The channel also allows layered windings terminating at the same end of the inner portion to be formed from an odd number of winding passes, reducing corona voltage breakdown effect and so prolonging the practical life of the windings. This also allows the inner portion to be wound uninterruptedly by machine without manual intervention.

23 Claims, 7 Drawing Sheets

FIG.1A
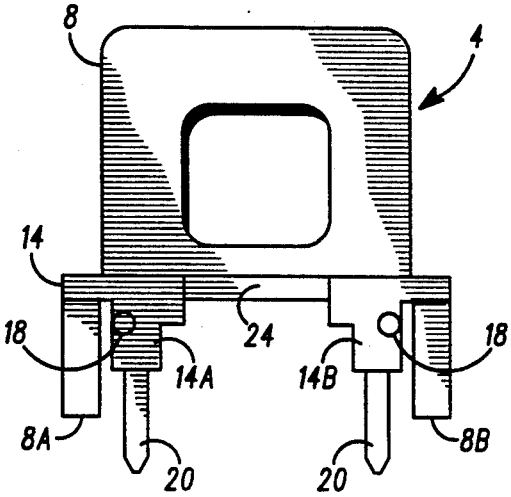
FIG.1B
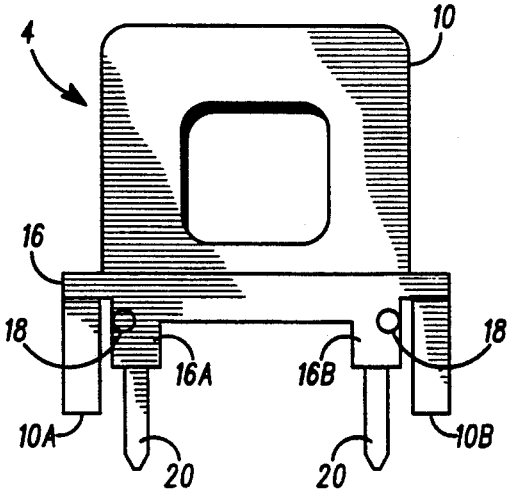
FIG.1C
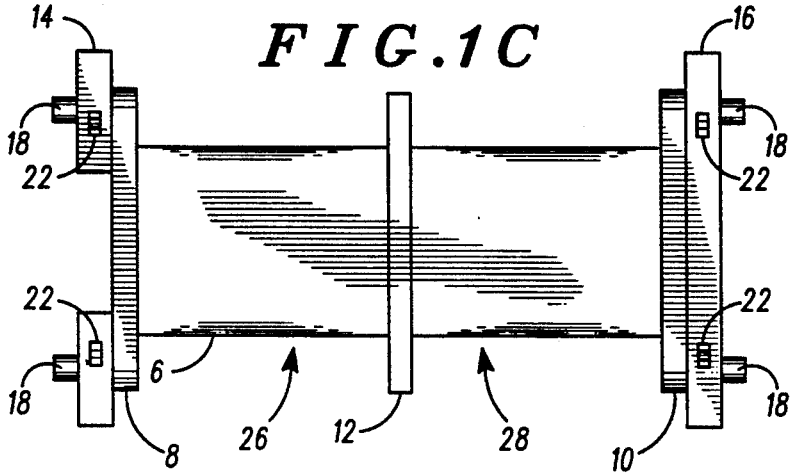
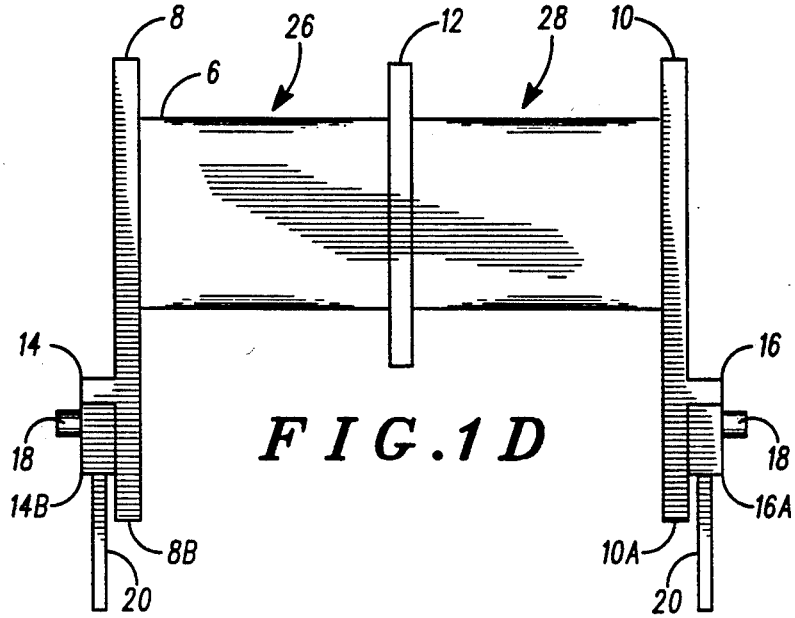
FIG.1D

FIG. 2A
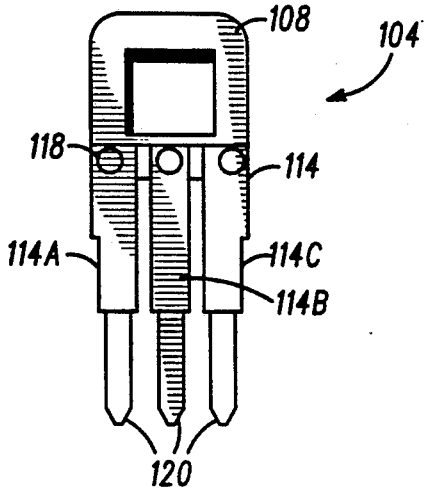
FIG. 2B
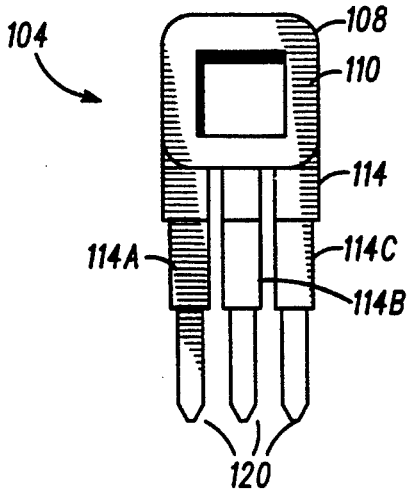
FIG. 2C
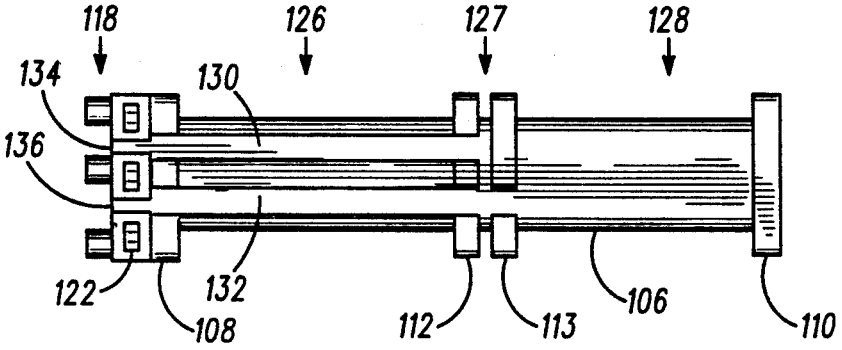
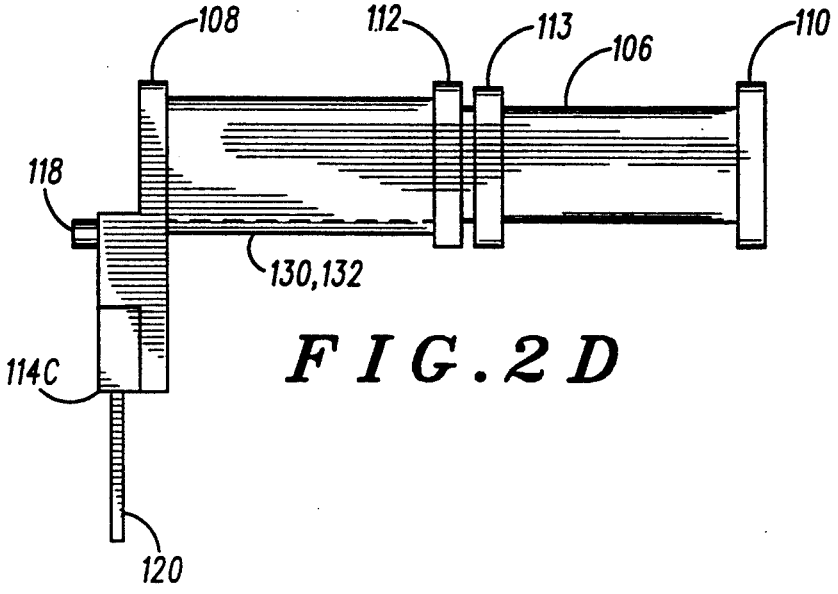
FIG. 2D

FIG. 3A
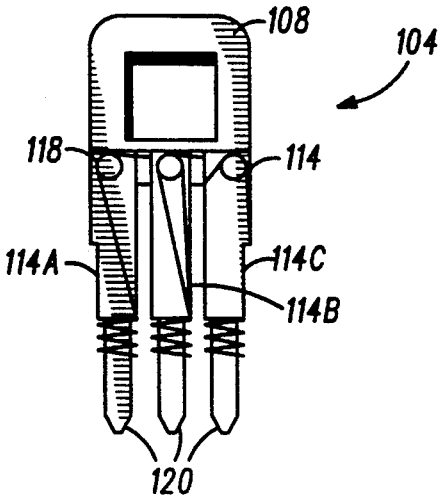
FIG. 3B
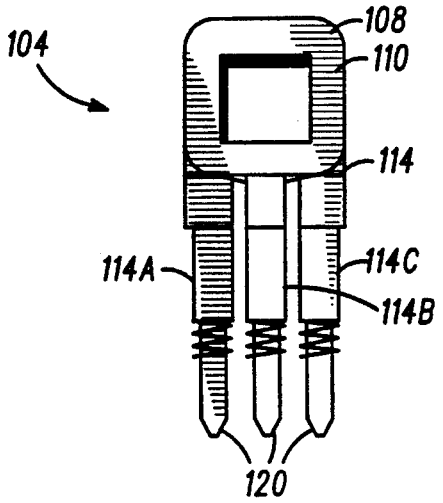
FIG. 3C
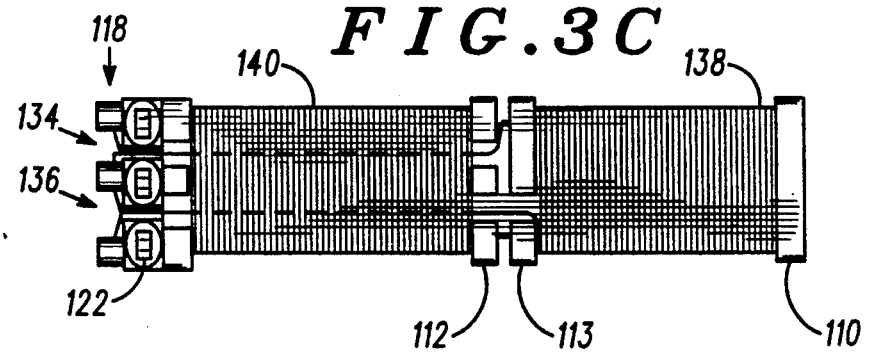
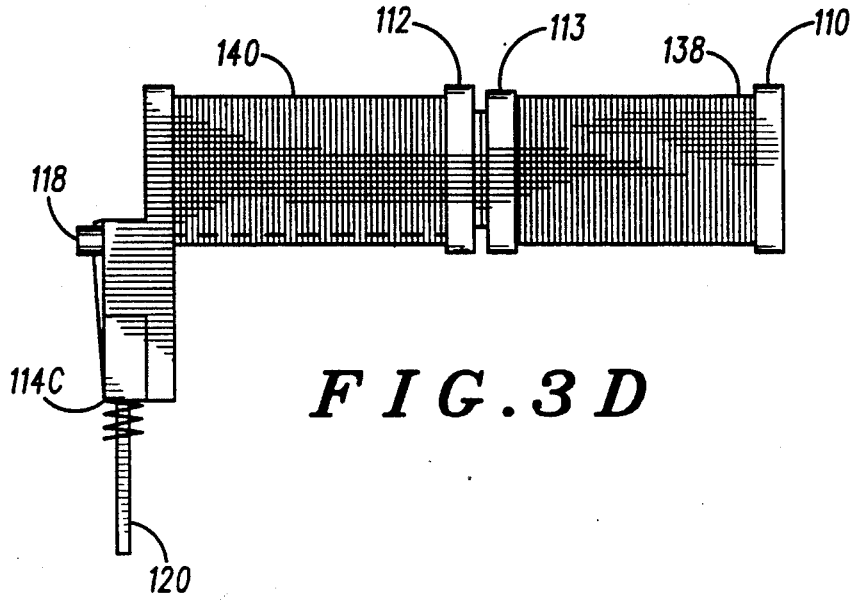
FIG. 3D

FIG. 4A
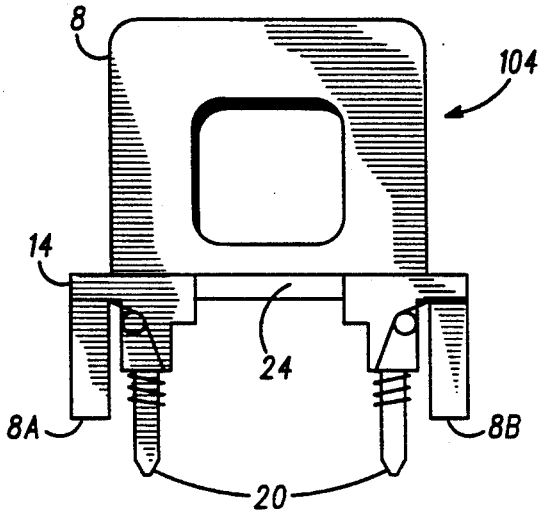
FIG. 4B
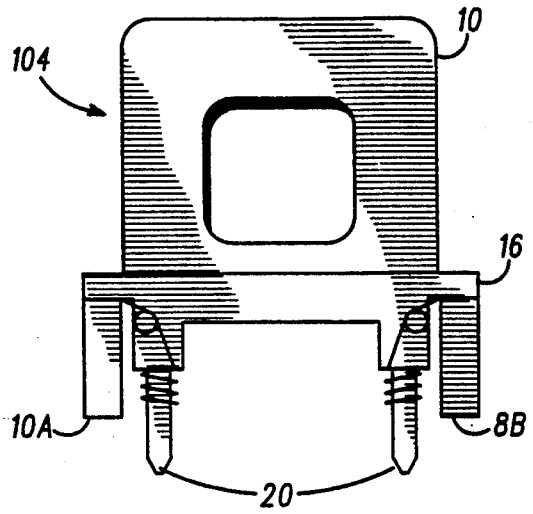
FIG. 4C
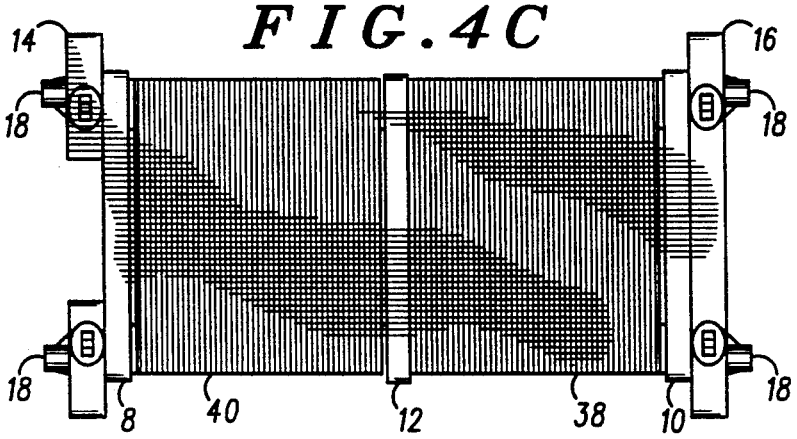
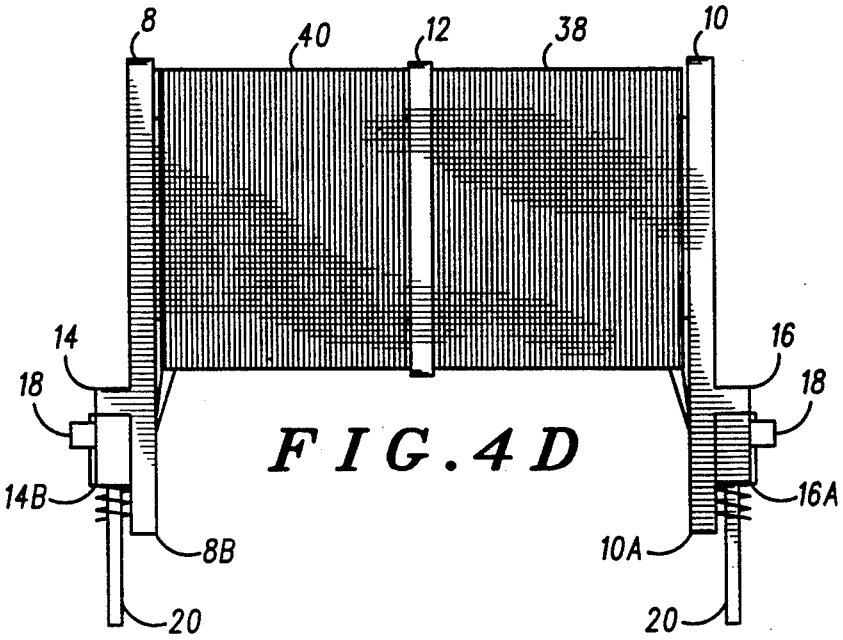
FIG. 4D

FIG.5A
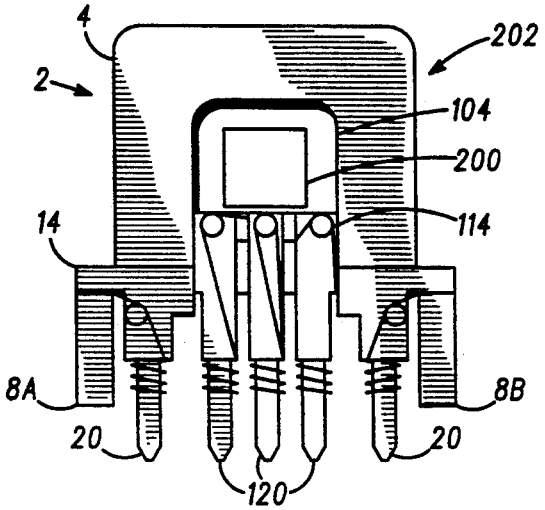
FIG.5B
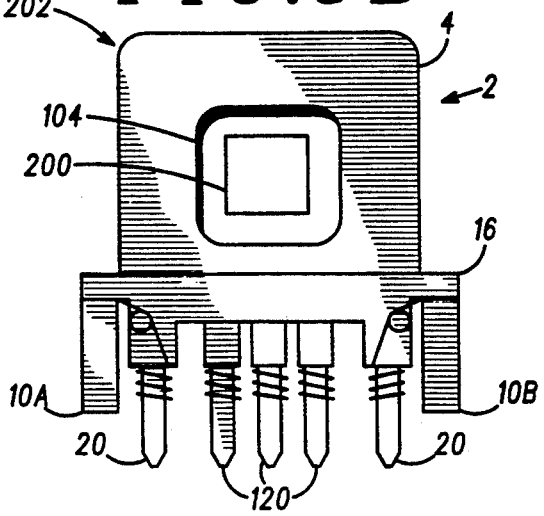
FIG.5C
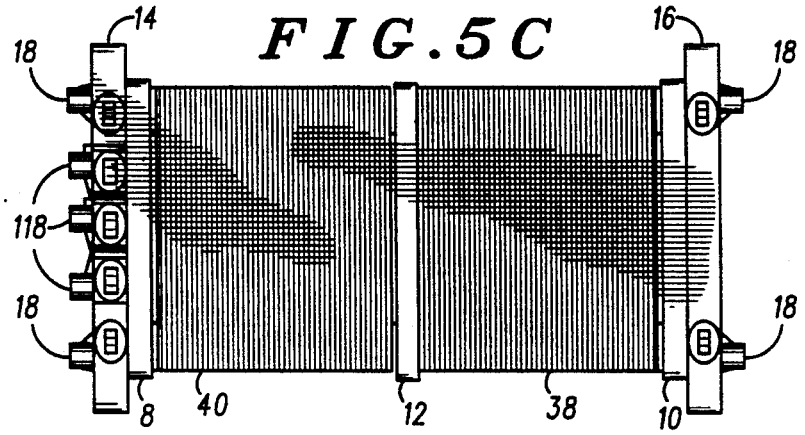
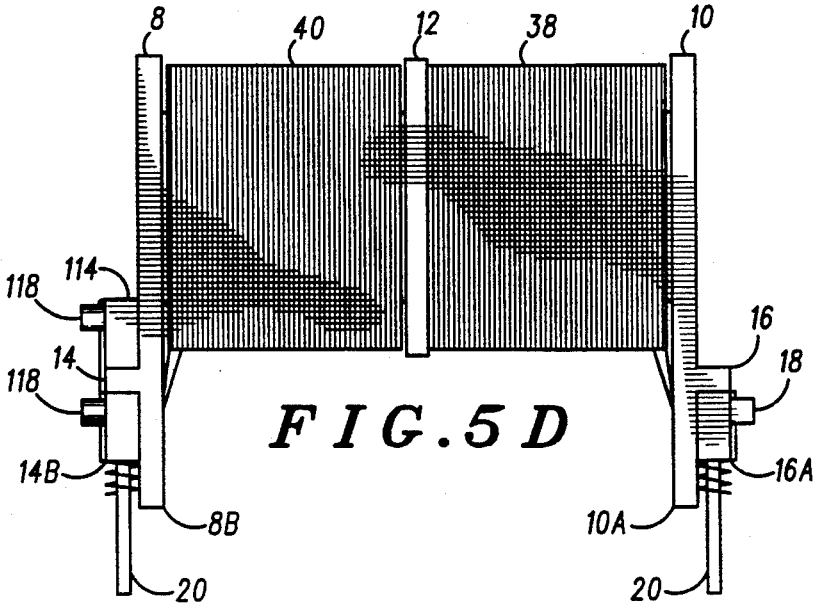
FIG.5D

FIG.6A
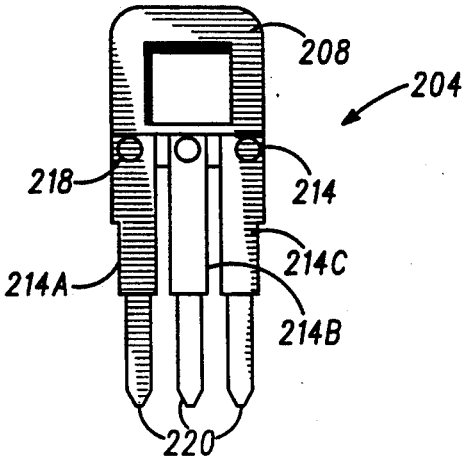
FIG.6B
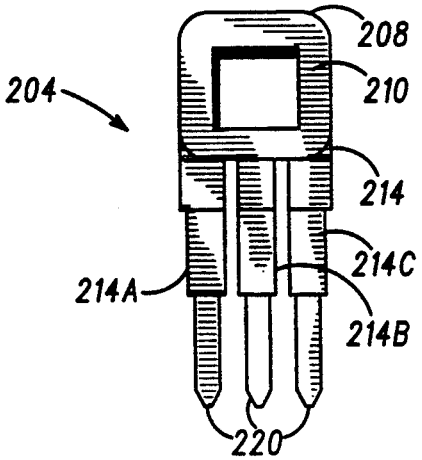
FIG.6C
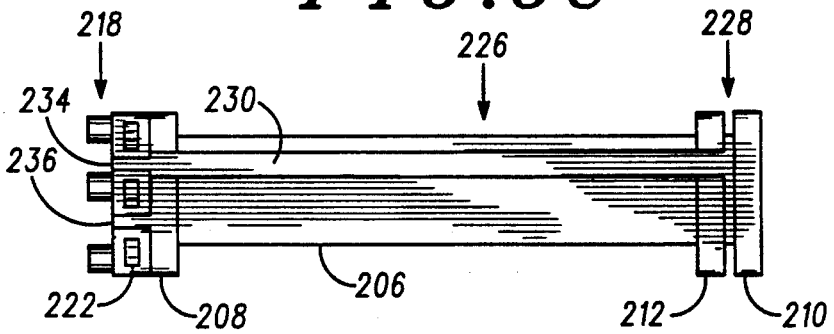
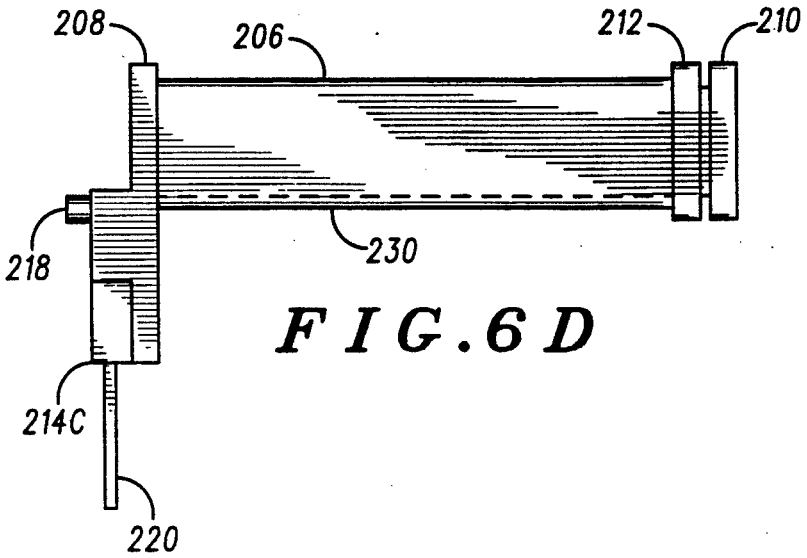
FIG.6D

FIG.7A
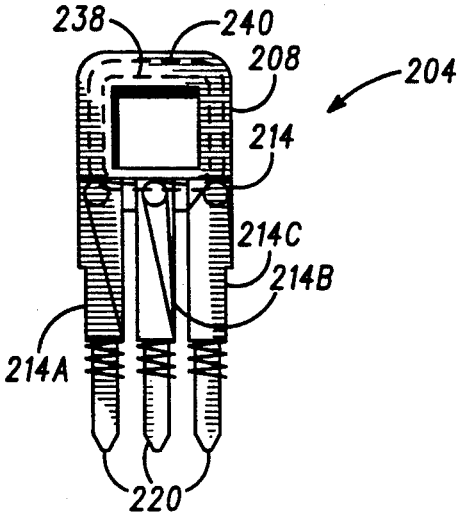
FIG.7B
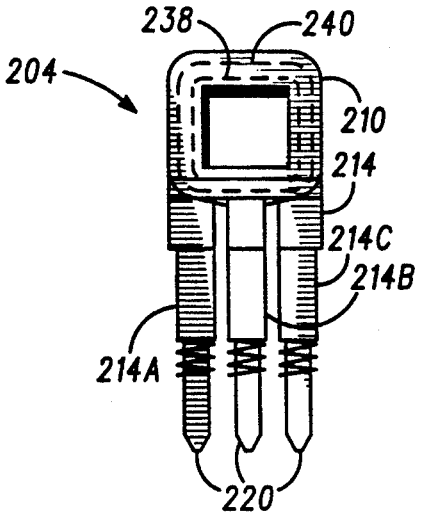
FIG.7C
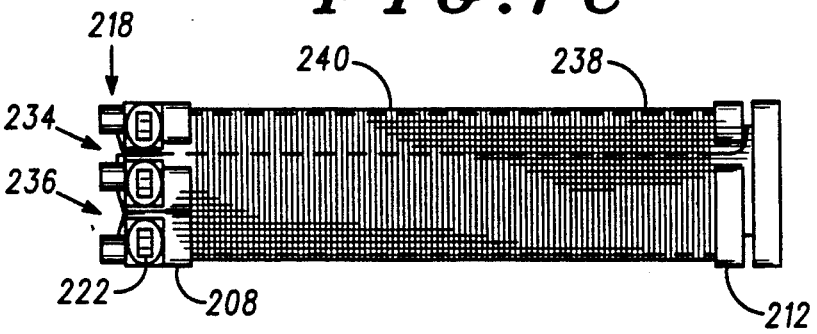
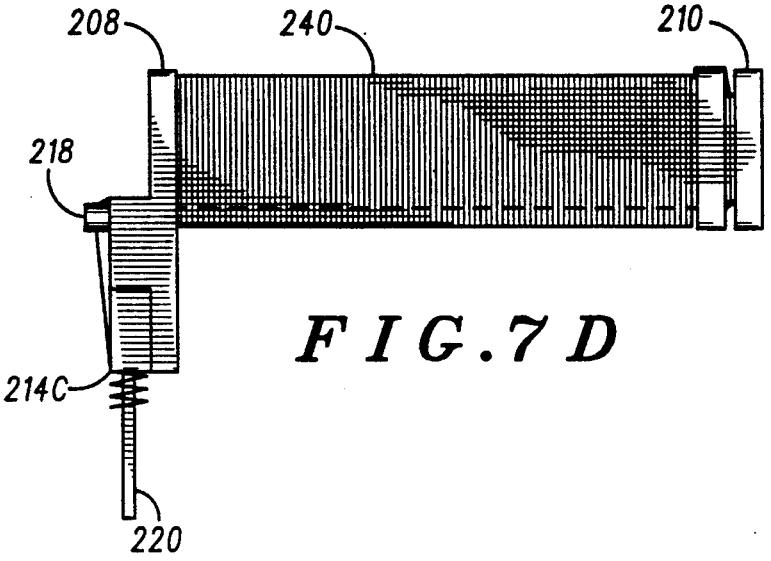
FIG.7D

BOBBIN FOR ELECTRICAL WINDINGS

FIELD OF THE INVENTION

This invention relates to bobbins for electrical windings. Such bobbins are used to support the electrical windings and terminals of electrical components such as transformers.

BACKGROUND OF THE INVENTION

In a typical transformer bobbin a non-conductive body supports a plurality of electrical windings, and conductive terminals are embedded in the body. The terminals are connected to respective ends of the windings, and the terminals extend from the body to form external connection terminals (e.g., for insertion in and soldering to a printed circuit board).

In a sectored bobbin, the bobbin typically has a longitudinal form with a hollow interior in which a core member is inserted, and the individual windings are typically wound circumferentially around the bobbin in annular recesses located in sectors spaced therealong. If, as is often desired, the external terminals are at only one end of the bobbin, the windings are typically wound in sequence beginning with that nearest to the terminals and ending with that farthest from the terminals, and the bobbin is typically provided with spacing formations for holding the wire of a farther winding radially outwardly from the nearer winding(s) as the wire extends between the farther winding and the terminals in order to avoid voltage breakdown.

In a layered bobbin, the bobbin typically has a longitudinal form with a hollow interior in which a core member is inserted, and the individual windings are typically wound circumferentially in an annular recess around the bobbin on top of each other at radially spaced positions therearound. If, as is often desired, the external terminals are at only one end of the bobbin and it is desired to begin a winding at one end of the bobbin and to end it at an opposite end, the bobbin is typically provided with a spacing formation for holding the winding wire radially outwardly from the winding as the wire extends between the far end of the winding and the terminals in order to avoid voltage breakdown.

If the bobbin is to support a large number of windings, it may be made of two separate longitudinal portions, one of which fits longitudinally inside the other, and each of which carry windings. The inner bobbin portion must have its terminations at only one thereof so that its other end can fit longitudinally into the outer bobbin portion. In such a bobbin, the use of the spacing arrangement described above to avoid voltage breakdown in the inner portion's windings increases the cross-sectional area of the inner portion and thus increases the size of the outer portion and so increases the size, weight and cost of the resulting transformer. Also in such a bobbin, the use of the spacing arrangement described above to separate the wires of the inner portion's windings increases the air gap between the windings of the inner and outer portions of the core, reducing the magnetic performance of the transformer.

SUMMARY OF THE INVENTION

In accordance with the invention there is provided a bobbin for electrical windings, the bobbin comprising:

an inner portion for supporting a first electrical winding therearound, the inner portion having a recess therein for receiving a magnetic core member; and an outer portion for supporting a second electrical winding therearound and having a formation therein for receiving the inner portion;

wherein the inner portion further has:

an end for termination of the first winding;

an annular recess therearound for receiving the first winding; and a channel communicating between the end of the inner portion and an end of the annular recess remote from the end of the inner portion, the channel being positioned radially inwardly of the annular recess.

It will be understood that by providing the channel radially inwardly of the annular recess, winding wire can extend between the end of the inner portion and the end of the annular recess remote from the end of the inner portion across the annular recess without significantly increasing the size of the inner portion and without increasing the gap between the inner and outer portions. This allows the size, weight and cost of a transformer built with the bobbin to be reduced, and improves the transformer's magnetic performance.

In a preferred embodiment, the inner portion has two layered windings thereon and the end of the inner portion has first second and third terminations between which the two layered windings are connected. One of the layered windings has its wire connected to the first termination and extends therefrom through the channel and is wound in a single pass back towards the termination end of the inner portion where it is connected to the second termination. The winding wire then continues as the other of the layered windings and is wound in two passes (respectively away from and towards the termination end of the inner portion) and is connected to the third termination.

This winding arrangement reduces the total number of passes required and so reduces corona voltage breakdown effect to which the windings are subject in use over a period of time, and so prolongs the practical life of the windings until breakdown occurs.

This winding arrangement also allows the individual winding passes to be wound directly on top of each other without the need for intermediate layers of insulating material therebetween which are conventionally manually applied. This allows the winding of the entire bobbin inner portion to be performed uninterruptedly on a conventional winding machine without manual intervention, enabling the bobbin to be produced more cheaply and more reliably.

BRIEF DESCRIPTION OF THE DRAWINGS

One transformer including a two-part bobbin in accordance with the present invention will now be described, by way of example only, with reference to the accompanying drawings, in which:

FIGS. 1A, 1B, 1C, and 1D show respectively elevational views of opposite ends, a plan view from below, and an elevational view of a side, of an outer portion of the bobbin for use in the transformer;

FIGS. 2A, 2B, 2C, and 2D show respectively elevational views of opposite ends, a plan view from below, and an elevational view of a side, of an inner portion of the bobbin whose outer portion is shown in FIG. 1;

FIGS. 3A, 3B, 3C, and 3D show respectively elevational views of opposite ends, a plan view from below, and an elevational view of a side, of the inner portion of FIGS. 2 and 3 with two sectored windings assembled thereon;

FIGS. 4A, 4B, 4C, and 4D show respectively elevational views of opposite ends, a plan view from below, and an elevational view of a side, of the outer portion of FIG. 1 with two windings assembled thereon; and FIGS. 5A, 5B, 5C, and 5D show respectively elevational views of opposite ends, a plan view from below, and an elevational view of a side, of the transformer assembled from the bobbin portions of FIGS. 3 and 4;

FIGS. 6A, 6B, 6C, and 6D show respectively elevational views of opposite ends, a plan view from below, and an elevational view of a side, of an inner portion, alternative to the inner portion shown in FIGS. 2 and 3, suitable for use with the outer portion shown in FIG. 1; and FIGS. 7A, 7B, 7C, and 7D show respectively elevational views of opposite ends, a plan view from below, and an elevational view of a side, of the alternative inner portion of FIG. 7 with two layered windings assembled thereon.

DESCRIPTION OF THE PREFERRED EMBODIMENT

Referring firstly to FIGS. 1A-D, a two-part bobbin 2 (shown assembled in FIGS. 5A-D) has an outer portion 4 with a longitudinal, hollow portion 6 having a generally square cross-section. The hollow portion 6 has at each end thereof a generally square flange plate 8 and 10 respectively. The hollow portion 6 also has a generally square intermediate flange plate 12 positioned equidistantly between the end flange plates 8 and 10. The outer portion 4 of the bobbin 2 is formed as a single piece molding of plastics material.

The end flange plates 8 and 10 are each provided at opposite ends of their bottom edges with two downwardly extending feet 8A and 8B and 10A and 10B respectively. The end flange plates 8 and 10 are also each provided along the length of their bottom edges with a shoulder 14 and 16 respectively. The shoulders 14 and 16 extend across their respective flange plates perpendicularly to the length of the hollow portion 6, and extend laterally outwardly in opposite directions parallel to the length of the hollow portion 6. Each of the shoulders 14 and 16 has two columnar portions 14A and 14B and 16A and 16B respectively spaced along the length of the shoulder and extending downwardly therefrom. Each of the columnar portions 14A and 14B and 16A and 16B has a post 18 respectively associated therewith, the posts of each shoulder extending outwardly in opposite directions parallel to the length of the portion 6.

Each of the columnar portions has vertically extending from its lower surface a pin 20. The pins are inserted in holes 22 in the bobbin outer portion which extend to the top surface of the shoulders 14 and 16 respectively. The pins are made of ribbon wire of rectangular cross-section offering increased resistance to bending in one lateral direction and offering reduced resistance to bending in a perpendicular lateral direction. Such pins, their manufacture and their insertion into a bobbin is described more fully in a U.S. patent application filed on the same date as, and assigned to the same assignee as, the present application and entitled "BOBBIN FOR AN ELECTRICAL WINDING AND METHOD OF MANUFACTURE THEREOF", Ser. No. 07/719,216, which is hereby incorporated herein by reference.

The flange plates 8 and 12 define between them a recess 26 which extends circumferentially around the hollow portion 6, and the flange plates 10 and 12 define between them a recess 28 which extends circumferentially around the hollow portion 6.

The shoulder 14 has a lateral cut-out 24 in its center below the hollow portion 6 to accommodate part of an inner portion of the bobbin which will be described below.

Referring now also to FIGS. 2A-D, an inner portion 104 has a longitudinal, hollow portion 106 with a generally square cross-section. The hollow portion 106 has at each end thereof a generally square flange plate 108 and 110 respectively. The hollow portion 106 also has two generally square intermediate flange plates 112 and 113 positioned near to each other and approximately equidistantly between the end flange plates 106 and 108. The inner portion 104 of the bobbin 2 is formed, like the outer portion 4, as a single piece molding of plastics material, and is designed to fit within the hollow portion 6 of the bobbin's outer portion 4 as will be described below.

The end flange plate 108 is provided along the length of its bottom edge with a shoulder 114. The shoulder 114 on the flange plate 108 extends laterally outwardly in the direction of the length of the hollow portion 106. The length of the shoulder 114 is slightly less than the length of the cut-out 24 in the outer portion's shoulder 14 so as to fit snugly in the cut-out as will be described below. The shoulder 114 has three columnar portions 114A, 114B and 114C spaced along the length of the shoulder and extending downwardly therefrom. Each of the columnar portions 114A, 114B and 114C has a post 118 respectively associated therewith, the posts each extending outwardly in a direction parallel to the length of the hollow portion 106.

Each of the columnar portions has vertically extending from its lower surface a pin 120. The pins are inserted in holes 122 in the bobbin inner portion 104 which communicate with the top surface of the shoulder 114. The pins 120 are identical with the pins 20 and are inserted in the same way.

The flange plates 108 and 112 define between them a wide annular recess 126 which extends circumferentially around the hollow portion 106; the flange plates 110 and 113 define between them a narrow annular recess 127 which extends circumferentially around the hollow portion 106; and the flange plates 110 and 113 define between them a wide annular recess 128 which extends circumferentially around the hollow portion 106. The lower wall of the hollow portion 106 has in the region of the recess 126 two channels 130 and 132. The channel 130 runs parallel to the length of the hollow portion 106 from the recess 127 to a slot 134 between the columnar portions 114B and 114C. The channel 132 runs parallel to the length of the hollow portion 106 from the recess 128 to a slot 136 between the columnar portions 114A and 114B. For reasons which will be explained below, it should be noted that the posts 118 have their top surfaces located adjacent the radially innermost surfaces of the channels 130 and 132, and the flange plate 113 has its top edge positioned slightly vertically lower than that of the flange plate 112, as can be seen in FIG. 2D.

Referring now also to FIGS. 3A-D, an initial wire winding 138 is wound circumferentially around the hollow portion 106 in the recess 128. The winding 138 is produced by first winding wire three times around the exposed portion of the left-most pin 120 (as seen in FIGS. 2A and 3A) immediately beneath the lower surface of the shoulder 114. The wire is then wound over the respective post 118, for strain relief, positioned in the slot 134 and extended in and along the channel 132 through the flange plate 112 and through the flange plate 113 until it emerges in the recess 128. The wire is then wound to the left and up (as seen in FIGS. 2A and 3A) and is wound circumferentially, clockwise (as seen in FIGS. 2A and 3A), around the hollow portion 106 within the recess 128 for the desired number of turns.

When the desired number of turns has been completed, the wire is wound back over the lower top edge of the flange plate 113 into the narrow annular recess 127 between the flange plates 112 and 113. The wire is then wound clockwise (as seen in FIGS. 2A and 3A) in the narrow annular recess 127 through approximately 180° until it is adjacent the channel 130. The wire is then positioned in the channel 130 and extended along the channel and through the slot 136 until it emerges adjacent the center post 118 (as seen in FIGS. 2A and 3A). Lastly the wire is wound over the center post 118, for strain relief, and then wound three times around the exposed portion of the center pin 120 immediately beneath the lower surface of the shoulder 114.

The wire is kept under tension throughout this winding process, and it will be understood that the wire is retained deep within the channel 132 throughout the channel's length since (i) the vertical position of the post 118 of the left-most pin 120 relative to the channel 132 holds the wire deep within the channel at one end, (ii) the upward winding of the wire when it emerges from the flange plate 113 into the recess 128 holds the other end of the wire deep within the channel at its other end, and (iii) the tension in the wire holds the length of the wire deep within the channel between its ends. Similarly, it will be understood that the wire is retained deep within the channel 130 throughout the channel's length since (i) the vertical position of the post 118 of the center pin 120 relative to the channel 130 holds the wire deep within the channel at one end, (ii) the winding of the wire clockwise through approximately 180° in the recess 127 holds the other end of the wire deep within the channel at its other end, and (iii) the tension in the wire holds the length of the wire deep within the channel between its ends.

With the same unbroken wire, a final winding 140 is then wound circumferentially around the hollow portion 106 in the recess 126. The winding 140 is produced by first leading the wire, as it leaves the center pin 120, back over the center post 118 and through the slot 134 so that it emerges in the recess 126. The wire is then wound circumferentially clockwise (as seen in FIGS. 2A and 3A) around the hollow portion 106 within the recess 126 for the desired number of turns. When the desired number of turns has been completed, the wire is led through the slot 136 and is wound over the right-most post 118 (as seen in FIGS. 2A and 3A), for strain relief, and then wound three times around the exposed portion of the right-most pin 120 immediately beneath the lower surface of the shoulder 114.

The wire is finally pulled laterally away from the right-most pin 120 in the plane of FIGS. 2A and 3A until the tension in the wire exceeds the breaking strength of the wire, at which point the wire breaks, leaving the sectored windings 138 and 140 complete as shown in FIGS. 3A–D. It will be appreciated that since the wire is pulled away from the pins 120 in the direction of the pins' larger cross-sectional dimension, the pins accommodate the stress to which they are subjected without bending.

Referring now to FIGS. 4A-D, in a separate operation to the winding of the bobbin inner portion 104, windings 38 and 40 are wound in the recesses 28 and 26 respectively on the bobbin outer portion 4 The winding 38 is produced by first winding wire three times around the exposed portion of the left-most pin 20 (as seen in FIG. 4B) immediately beneath the lower surface of the shoulder 16. The wire is then wound over the respective post 18, for strain relief, and then wound circumferentially around the the hollow portion 6 within the recess 28 for the desired number of turns. When the desired number of turns has been completed, the wire is wound over post 118 of the right-most pin 20 (as seen in FIG. 4B), for strain relief, and then wound three times around the exposed portion of the right-most pin 20 immediately beneath the lower surface of the shoulder 16. The wire is finally pulled laterally away from the right-most pin 20 in the plane of FIG. 4B until the tension in the wire exceeds the breaking strength of the wire, at which point the wire breaks, leaving the winding 38 complete as shown in FIG. 4.

Analogously to the winding 38, the winding 40 is produced by first winding wire three times around the exposed portion of the left-most pin 20 (as seen in FIG. 4A) immediately beneath the lower surface of the shoulder 14. The wire is then wound over the respective post 18, for strain relief, and then wound circumferentially around the the hollow portion 6 within the recess 26 for the desired number of turns. When the desired number of turns has been completed, the wire is wound over the post 18 of the right-most pin 20 (as seen in FIG. 4A), for strain relief, and then wound three times around the exposed portion of the right-most pin 20 immediately beneath the lower surface of the shoulder 14. The wire is finally pulled laterally away from the right-most pin 20 in the plane of FIG. 4A until the tension in the wire exceeds the breaking strength of the wire, at which point the wire breaks, leaving the winding 40 complete as shown in FIG. 4A–D.

With the windings 138 and 140 complete as shown in FIGS. 3A–D and the windings 38 and 40 complete as shown in 4A–D, the two parts of the bobbin are assembled by inserting the body of the inner portion 104 into the hollow interior of the body of the outer portion 4. The insertion is performed by first introducing the end of the inner portion 104 remote from the pins 120 into the end of the outer portion 4 adjacent the cut-out shoulder 14, and pushing the inner portion longitudinally into the outer portion until the shoulder 114 of the inner portion 104 rests snugly in the cut-out 24 in the shoulder 14 of the outer portion.

Referring now to FIGS. 5A-D, with the two parts of the bobbin assembled, the bobbin is then dipped into a molten solder bath (not shown) to a depth sufficient just to cover the exposed portions of the pins 20 and 120 and the three turns of wire winding around the pins immediately below the shoulders 14, 16 and 114. The bobbin is then removed from the solder bath and the solder adhering to the bobbin is allowed to solidify, thus forming a soldered connection between the windings 38, 40, 138 and 140 pins 20 and 120. Lastly, a core 200 is inserted into the hollow interior of the bobbin's inner portion 104 and is held in place by spring clips (not shown) to complete a transformer 202 with the pins 20 and 120 forming the transformer's external connections.

It will be understood that by providing the channels 30 and 132 across the width of the recess 126 and radially inwardly of the recess, no significant increase in size of the inner portion is occasioned in order for the wire for the winding 138 to be clear of that for the winding 140. This minimizes the size of inner portion 104 and hence also minimizes the size of the outer portion into which the inner portion must fit and so ultimately minimizes the size, and therefore material cost and weight, of the resulting transformer.

It will also be understood that by providing the channels 130 and 132 radially inwardly of the recess 126, the windings 138 and 140 of the bobbin inner portion are brought optimally close to the windings 38 and 40 of the bobbin outer portion, thus ensuring good magnetic coupling between the windings of the inner and outer portions.

Referring now also to FIGS. 6A–D, a bobbin inner portion 204, alternative to the inner portion shown in FIGS. 2A–D and 3A–D, has a longitudinal, hollow portion 206 with a generally square cross-section. The hollow portion 206 has at each end thereof a generally square flange plate 208 and 210 respectively. The hollow portion 206 also has a generally square intermediate flange plate 212 positioned near to and slightly inwardly of the end flange plate 208. The inner portion 204 of the bobbin 2 is formed, like inner portion 104, as a single piece molding of plastics material, and is designed to fit within the hollow portion 106 of the bobbin outer portion 4 described above.

The end flange plate 208 is provided along the length of its bottom edge with a shoulder 214. The shoulder 214 on the flange plate 208 extends laterally outwardly in the direction of the length of the hollow portion 206. The length of the shoulder 214 is slightly less than the length of the cut-out 24 in the outer portion's shoulder 14 so as to fit snugly in the cut-out as will be described below. The shoulder 214 has three columnar portions 214A, 214B and 214C spaced along the length of the shoulder and extending downwardly therefrom. Each of the columnar portions 214A, 214B and 214C has a post 218 respectively associated therewith, the posts each extending outwardly in a direction parallel to the length of the hollow portion 206.

Each of the columnar portions has vertically extending from its lower surface a pin 220. The pins are inserted in holes 222 in the bobbin inner portion 204 which communicate with the top surface of the shoulder 214. The pins 220 are identical with the pins 20 and 120 and are inserted in the same way.

The flange plates 208 and 212 define between them a wide annular recess 226 which extends circumferentially around the hollow portion 206; the flange plates 212 and 10 define between them a narrow annular recess 228 which extends circumferentially around the hollow portion 206. The lower wall of the hollow portion 206 has in the region of the recess 226 a channel 230. The channel 230 runs parallel to the length of the hollow portion 206 from the recess 228 to a slot 234 between the columnar portions 214B and 214C. A slot 236 is defined between the columnar portions 214A and 214B. For reasons which will be explained below, it should be noted that the posts 218 have their top surfaces located adjacent the radially innermost surface of the channel 230, and the flange plate 212 has its top edge positioned slightly vertically lower than that of the flange plate 210, as can be seen in FIG. 6D.

Referring now also to FIGS. 7A–D, an initial wire winding 238 is wound circumferentially around the hollow portion 206 in the recess 228. The winding 238 is produced by first winding wire three times around the exposed portion of the right-most pin 220 (as seen in FIGS. 6A and 7A) immediately beneath the lower surface of the shoulder 214. The wire is then wound over the respective post 218, for strain relief, positioned in the slot 234 and extended in and along the channel 230 through the flange plate 212 until it emerges in the recess 128. The wire is then wound to the right and up (as seen in FIGS. 6A and 7A) and is wound circumferentially, counter-clockwise (as seen in FIGS. 6A and 7A) through approximately 180°, around the hollow portion 206 within the narrow annular recess 228. The wire is then wound back over the lower top edge of the flange plate 212 into the wide annular recess 216 between the flange plates 208 and 212. The wire is then wound counter-clockwise (as seen in FIGS. 6A and 7A) in the wide annular recess 226 towards the end flange plate 208 in a single pass until the desired number of turns has been completed and the wire is adjacent the end flange plate 208. The wire is then extended through the slot 236 until it emerges adjacent the center post 218 (as seen in FIGS. 6A and 7A). Lastly the wire is wound over the center post 218, for strain relief, and then wound three times around the exposed portion of the center pin 220 immediately beneath the lower surface of the shoulder 214.

The wire is kept under tension throughout this winding process, and it will be understood that the wire is retained deep within the channel 230 throughout the channel's length since (i) the vertical position of the post 218 of the right-most pin 220 relative to the channel 230 holds the wire deep within the channel at one end, (ii) the upward winding of the wire when it emerges from the flange plate 212 into the recess 228 holds the other end of the wire deep within the channel at its other end, and (iii) the tension in the wire holds the length of the wire deep within the channel between its ends.

With the same unbroken wire, a final winding 240 is then wound circumferentially around the winding 238 in the recess 226, on top of (i.e., spaced radially outwardly from the winding 238). The winding 240 is produced by first leading the wire, as it leaves the center pin 220, back over the center post 218 and through the slot 236 so that it emerges in the recess 226. The wire is then wound circumferentially counter-clockwise (as seen in FIGS. 6A and 7A) around the winding 238 within the recess 226 towards the flange plate 212; when the flange plate 212 is reached, the the winding continues in a reverse pass back towards the end flange plate 208. When the wire is adjacent to the end flange plate 208 and the desired number of turns has been completed, the wire is led through the slot 234 and is wound over the right-most post 218 (as seen in FIGS. 6A and 7A), for strain relief, and then wound three times around the exposed portion of the right-most pin 220 immediately beneath the lower surface of the shoulder 214.

The wire is finally pulled laterally away from the left-most pin 220 in the plane of FIGS. 6A and 7A until the tension in the wire exceeds the breaking strength of the wire, at which point the wire breaks, leaving the layered windings 238 and 240 complete as shown in FIGS. 7A–D. It will be appreciated that since the wire is pulled away from the pins 220 in the direction of the pins' larger cross-sectional dimension, the pins accommodate the stress to which they are subjected without bending.

The windings 238 and 240 are thus formed on the bobbin inner portion 204 in a total of just three passes: one pass for the winding 238 and two passes for the winding 240. It will be appreciated that this low total number of passes reduces corona voltage breakdown effect to which the windings are subject in use over a period of time, and so prolongs the practical life of the windings until breakdown occurs.

It will also be appreciated that this winding arrangement also allows the individual winding passes to be wound directly on top of each other without the need for intermediate layers of insulating material therebetween which are conventionally manually applied. This allows the winding of the entire bobbin inner portion 204 to be performed uninterruptedly on a conventional winding machine without manual intervention, enabling the bobbin to be produced more cheaply and more reliably.

With the windings 238 and 240 complete as shown in FIGS. 7A–D, the alternative bobbin inner portion 204 and the bobbin outer portion 4 are assembled, as in the case of the bobbin 2, by inserting the body of the inner portion 204 into the hollow interior of the body of the outer portion 4. The insertion is performed by first introducing the end of the inner portion 204 remote from the pins 220 into the end of the outer portion 4 adjacent the cut-out shoulder 14, and pushing the inner portion longitudinally into the outer portion until the shoulder 214 of the inner portion 104 rests snugly in the cut-out 24 in the shoulder 14 of the outer portion.

With the two parts of the bobbin assembled, the bobbin is then soldered and has a core (not shown) inserted and retained by spring clips (also not shown), as described above with respect to the bobbin 2, to complete a transformer (also not shown) with the pins 20 and 220 forming the transformer's external connections.

It will be appreciated that the use of the channel 230 allows the winding 238 to have its ends separated from each other to avoid voltage breakdown therebetween. It will be appreciated that the use of the channel 230 allows the winding 238 to begin being wound from the end of the recess 226 remote from the pins 220, allowing the total winding (made up of the windings 238 and 240) to be formed in an odd number of passes along the length of the recess 226.

It will be understood that, as in the bobbin 2 described above, in the alternative bobbin inner portion 204 by providing the channels 230 across the width of the recess 226 and radially inwardly of the recess, no significant increase in size of the inner portion is occasioned in order to avoid voltage breakdown. This minimizes the size of inner portion 104 and hence also minimizes the size of the outer portion into which the inner portion must fit and so ultimately minimizes the size, and therefore material cost and weight, of the resulting transformer.

It will also be understood that, as in the bobbin 2 described above, in the alternative bobbin inner portion 204 by providing the channel 230 radially inwardly of the recess 226, the windings 238 and 240 of the bobbin inner portion are brought optimally close to the windings 38 and 40 of the bobbin outer portion, thus ensuring good magnetic coupling between the windings of the inner and outer portions.

It will also be appreciated that various other modifications or alternatives to the above described embodiments will be apparent to a person skilled in the art without departing from the inventive concept.

We claim:

1. A bobbin for electrical windings, the bobbin comprising:

an inner portion for supporting a first electrical winding, the winding comprising an electrically conductive wire, therearound, the inner portion having a recess therein for receiving a magnetic core member; and an outer portion for supporting a second electrical winding therearound and having a recess therein for receiving the inner portion;

wherein the inner portion further has:

an end for termination of the first winding;

a first annular recess therearound for receiving the first winding;

a first channel communicating between the end of the inner portion and an end of the first annular recess remote from the end of the inner portion, the channel being positioned radially inwardly of the first annular recess, the channel having a depth greater than the diameter of the wire; and first winding maintaining means for maintaining the first winding proximate tot he bottom of the channel, such that an air gap is formed between a portion of the winding in the channel and the winding wound around the inner portion.

2. A bobbin according to claim 1 wherein the inner portion further has a second recess around at least part of the inner portion adjacent the first annular recess and remote from the end of the inner portion, the second recess being separated from the first annular recess by a formation through a first portion of which the first channel extends.

3. A bobbin according to claim 2 wherein the inner portion further has end walls at respective ends thereof, the second recess is an annular recess, and the formation separating the first annular recess from the second annular recess is an intermediate wall having at a second portion thereof a height less than the heights of the end walls.

4. A bobbin according to claim 3 wherein the second portion of the intermediate wall is substantially diametrically opposite the first portion of the intermediate wall.

5. A bobbin according to claim 1 wherein the inner portion further has a third annular recess therearound and spaced longitudinally from the first annular recess for receiving a third electrical winding.

6. A bobbin according to claim 5 wherein the inner portion further has a second channel communicating between the end of the inner portion and an end of the first annular recess remote from the end of the inner portion, the channel being positioned radially inwardly of the first annular recess, the second channel having a depth greater than the diameter of the third winding.

7. A bobbin comprising:

an inner portion supporting a first electrical winding therearound the inner portion having a recess therein for receiving a magnetic core member; and an outer portion supporting a second electrical winding therearound and having a recess therein for receiving the inner portion;

wherein the inner portion further has:

an end having a first termination connected to the first winding;

a first annular recess therearound in which the first winding is situated;

a first channel communicating between the end of the inner portion and an end of the first annular recess remote from the end of the inner portion, the channel being positioned radially inwardly of the first annular recess, the first channel accommodating a portion of the first winding, the first channel having a depth greater than the diameter of the winding;

first winding maintaining means for maintaining the wire at the bottom of the first channel, such that an air gap is formed between the wire and the winding wound around the inner potion.

8. A bobbin according to claim 7 wherein the inner portion further has a second recess around at least part of the inner portion adjacent the first annular recess and remote from the end of the inner portion, the second recess being separated from the first annular recess by a formation through a first portion of which the first channel extends and accommodates the portion of the first winding.

9. A bobbin according to claim 8 wherein the inner portion further has end walls at respective ends thereof, the second recess is an annular recess, and the formation separating the first annular recess from the second annular recess is an intermediate wall having at a second portion thereof a height less than the heights of the end walls.

10. A bobbin according to claim 9 wherein the second portion of the intermediate wall is substantially diametrically opposite the first portion of the intermediate wall.

11. A bobbin according to claim 8 wherein the inner portion further has a third annular recess therearound which is spaced longitudinally from the first annular recess and in which is situated a third electrical winding.

12. A bobbin according to claim 11 wherein:

the inner portion further has a second channel communicating between the end of the inner portion and an end of the first annular recess remote from the end of the inner portion, the channel being positioned radially inwardly of the first annular recess;

the end of the inner portion has second and third terminations connected respectively to the first and third windings; and the second channel accommodates a further portion of the first winding.

13. A bobbin according to claim 12 wherein the first winding is connected between the first and second terminations and the third winding is connected between the second and third terminations.

14. A bobbin according to claim 13 wherein the first winding and the third winding are formed of a continuous wire.

15. A bobbin according to claim 7 wherein:

the inner portion further has a third electrical winding situated in the first annular recess and radially spaced from the first electrical winding; and the end of the inner portion has second and third terminations connected respectively to the first and third windings.

16. A bobbin according to claim 15 wherein the first winding is connected between the first and second terminations and the third winding is connected between the second and third terminations.

17. A bobbin according to claim 16 wherein the first winding and the third winding are formed of a continuous wire.

18. A bobbin according to claim 15 wherein the first winding comprises a single pass of wire wound along the first annular recess and the third winding comprises a two passes of wire wound along the first annular recess.

19. A bobbin comprising:

an inner portion supporting a first electrical winding therearound, the inner portion having access therein for receiving a magnetic core member; and an outer portion for supporting a second electrical winding therearound and having a recess therein for receiving the inner portion;

wherein the inner portion further has:

a third electrical winding therearound;

an end having a first, second and third terminations connected to the first and third winding, the first winding being connected between the first and second terminations and the third winding being connected between the second and third terminations;

a first annular recess therearound in which the first winding and the third winding are situated at radially spaced positions;

a first channel communicating between the end of the inner portion and an end of the first annular recess remote from the end of the inner portion, the channel being positioned radially inwardly of the first annular recess, the first channel accommodating a portion of the first winding the channel having a depth greater than the diameter of the first electrical winding;

first winding maintaining means for maintaining the portion of the first winding in the channel proximate to the bottom of the channel.

20. A transformer having a bobbin comprising:

an inner portion supporting a first electrical winding therearound, the inner portion having a recess therein for receiving a magnetic core member; and an outer portion supporting a second electrical winding therearound and having a recess therein for receiving the inner portion;

wherein the inner portion further has:

an end having a first termination connected to the first winding;

a first annular recess therearound in which the first winding is situated;

a first channel communicating between the end of the inner portion and an end of the first annular recess remote from the end of the inner portion, the channel being positioned radially inwardly of the first annular recess, the first channel having a depth greater than the diameter of the first winding; and first winding maintaining means for maintaining the portion of the first winding at the bottom of the channel such that an air gap is formed between the portion of the first winding in channel and the remainder of the winding.

21. The bobbin of claim 4 where the first winding maintaining means is a first winding maintaining annular recess extending circumferentially about the bobbin, intermediate the first and second annular recess, first winding maintaining annular recess communicating with both the first channel and the first annular recess.

22. The bobbin of claim 6 further comprising second channel maintaining means for maintaining the third winding proximate the bottom of the second channel.

23. The bobbin of claim 21 where the second channel has a depth greater than the diameter of the third winding.

* * * * *